United States Patent [19]

Nussbaumer et al.

[11] Patent Number: 4,690,590

[45] Date of Patent: Sep. 1, 1987

[54] METHOD AND APPARATUS FOR POSITIONING DIAPHRAGMS IN VERTICAL SLOTTED WALLS WHICH ARE SUPPORTED BY A SUSPENSION

[75] Inventors: Manfred Nussbaumer, Leonberg; Eberhard Gläser, Aichwald; Eberhard Beitinger, Stuttgart, all of Fed. Rep. of Germany

[73] Assignee: Ed. Züblin Aktiengesellschaft, Stuttgart, Fed. Rep. of Germany

[21] Appl. No.: 768,420

[22] Filed: Aug. 22, 1985

[30] Foreign Application Priority Data

Aug. 22, 1984 [DE] Fed. Rep. of Germany ..... 3430792

[51] Int. Cl.[4] ..... E02D 5/20

[52] U.S. Cl. ..... 405/267; 405/258

[58] Field of Search ..... 405/36, 38, 50, 52, 405/53, 55, 226, 248, 258, 267, 270

[56] References Cited

U.S. PATENT DOCUMENTS

| | | | |
|---|---|---|---|
| 961,788 | 6/1910 | Moran | 405/248 |
| 2,354,936 | 8/1944 | Bignell | 405/248 |
| 3,645,101 | 2/1972 | Sherard | 405/267 |
| 4,249,836 | 2/1981 | Schmednecht | 405/267 |
| 4,320,989 | 3/1982 | Mamo | 405/52 |
| 4,519,729 | 5/1985 | Clarke | 405/267 X |

FOREIGN PATENT DOCUMENTS

| | | | |
|---|---|---|---|
| 209010 | 4/1984 | Fed. Rep. of Germany | 405/270 |
| 2492864 | 4/1982 | France | 405/270 |
| 2116614 | 9/1983 | United Kingdom | 405/248 |

*Primary Examiner*—Cornelius J. Husar
*Assistant Examiner*—Nancy J. Stodola
*Attorney, Agent, or Firm*—Becker & Becker, Inc.

[57] ABSTRACT

To reduce the shearing resistance at the surfaces of the diaphragm, and to decrease the buoyancy force, both of which greatly hamper the positioning of diaphragms or thin sheets in slotted wall suspensions, air bubbles are introduced at the bottom end of the diaphragm during the positioning process. These air bubbles ascend along the vertical surfaces of the diaphragm.

22 Claims, 5 Drawing Figures

FIG. 2
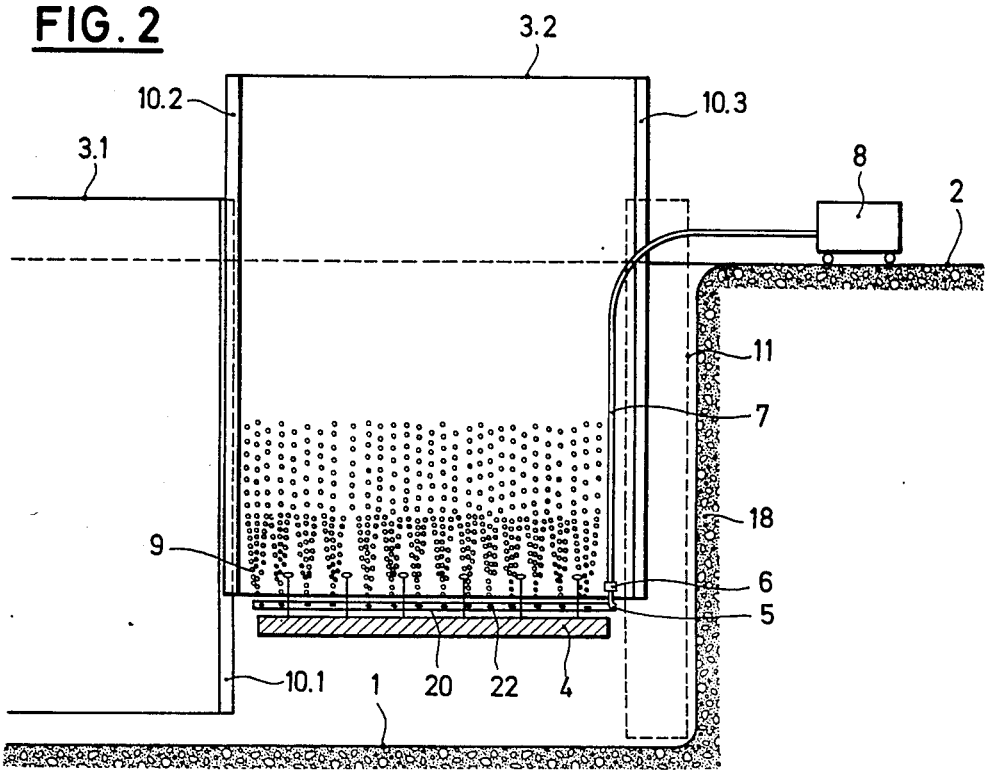
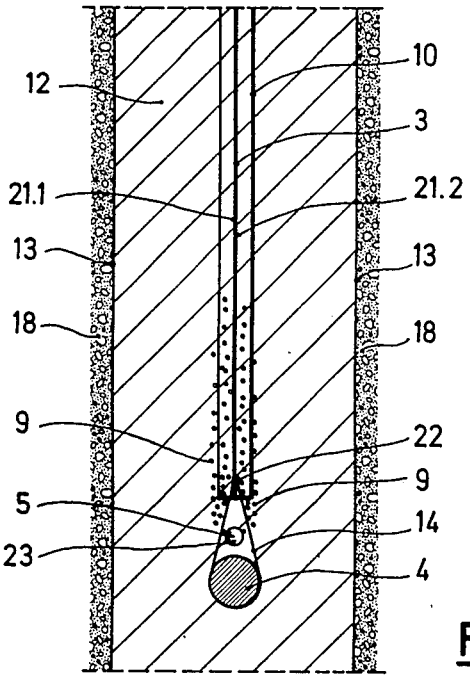
FIG. 3

METHOD AND APPARATUS FOR POSITIONING DIAPHRAGMS IN VERTICAL SLOTTED WALLS WHICH ARE SUPPORTED BY A SUSPENSION

BACKGROUND OF THE INVENTION

1. Field of the Invention

The present invention relates to a method and apparatus for positioning diaphragms in vertical slotted walls which are supported by a suspension, with respective diaphragm sections being lowered into the support suspension of the sealing wall mass.

2. Description of the Prior Art

Diaphragms or thin sheets are often installed as additional seals in vertical sealing walls, which are generally produced as slotted walls supported in suspensions. Such sealing slotted walls are particularly utilized in foundation work and water structures, but also for the vertical sealing of dumps. The sealing wall can be produced in a single or dual phase system. In the single phase system, either cement or some other hardening material is added to the support suspension of bentonite and water, with this suspension at the same time representing the final sealing wall mass. In the dual phase system, the actual support suspension of water and clay having thixotropic properties, such as bentonite, is replaced by the remaining sealing wall mass, such as concrete.

The diaphragm or thin sheet is predominantly positioned in the center of the slotted wall suspension as long as the latter has not yet hardened. The diaphragms are generally made of synthetic materials, such as PVC, PE, PP, or of thermoplastic elastomers on a base of natural or synthetic rubber. The positioning of the diaphragm in the support suspension is predominantly effected by weighting the bottom edge with steel sections or the like, and/or by using frames with which the diaphragm is forced into the support suspension.

In an article by Dipl.-Ing. Jaroslav Verfel, which appeared in TIS 10/82, the difficulties involved with the introduction of the diaphragm are explained in detail. The thin sheets, which are under buoyancy, can be positioned to a slotted wall depth of 10 m only at great technical expense. In particular, the viscosity of the suspension, expressed in the shearing strength $\tau_0$, increases with time, and with the use of a single phase system can within 24 hours exceed ten times the value of the fresh suspension mixture. With the use of a support suspension exclusively of bentonite and water, the viscosity of the suspension increases due to the thixotropic properties of the bentonite/water mixture. If the suspension in the slot settles, the platelet-like stratified silicates of the bentonite form a "house of cards" structure due to the different electrical charges of the surfaces and the edges. The edges or boundary of the slotted wall are supported by this "house of cards" structure.

It is an object of the present invention to provide a method which considerably simplifies the introduction of the diaphragm into the slotted wall. It is a further object of the present invention to provide an apparatus for effecting this facilitated introduction.

BRIEF DESCRIPTION OF THE DRAWINGS

These and other objects and advantages of the present invention will appear more clearly from the following specification in conjunction with the accompanying drawings, in which:

FIG. 2 is a schematic longitudinal sectional view through the slotted wall;

FIG. 3 is a schematic cross-sectional illustration showing an exemplary embodiment of the inventive arrangement at the bottom end of the diaphragm;

SUMMARY OF THE INVENTION

The method of the present invention is characterized primarily in that during the positioning process, air bubbles are introduced into the support suspension at the bottom edge of the diaphragm, with these air bubbles ascending along at least one of the two surfaces of the diaphragm.

The apparatus of the present invention for carrying out the aforementioned method is characterized primarily in that at least one air distributing device is disposed at the bottom edge of the diaphragm during the positioning process, with a supply line being provided for connecting the air distributing device with a compressed air generator and/or tank.

During the positioning process, air bubbles at the bottom edge of the diaphragm section bubble-up into the suspension-supported slotted wall, and ascend along the side surfaces of the membrane section. The upward flow of the air bubbles effects a locally limited loosening of the thixotropic structure of the support suspension and reduces the density of the suspension through which the air bubbles pass. The effects connected herewith include a reduction of the shearing strength at the side surfaces of the diaphragm, and a reduction of the buoyancy of the diaphragm; these effects considerably improve and facilitate the positioning process. The diaphragm can thus be positioned in the slotted wall suspension with small ballast weights, and in special situations without frame constructions.

The device for introducing the air bubbles can remain entirely or partially in the slotted wall along with the diaphragm section. On the other hand, after positioning of the diaphragm section has been completed, the device for introducing the air bubbles can be withdrawn entirely or partially, and can be reused.

Further features of the present invention will be described subsequently.

DESCRIPTION OF PREFERRED EMBODIMENTS

Figure 1:
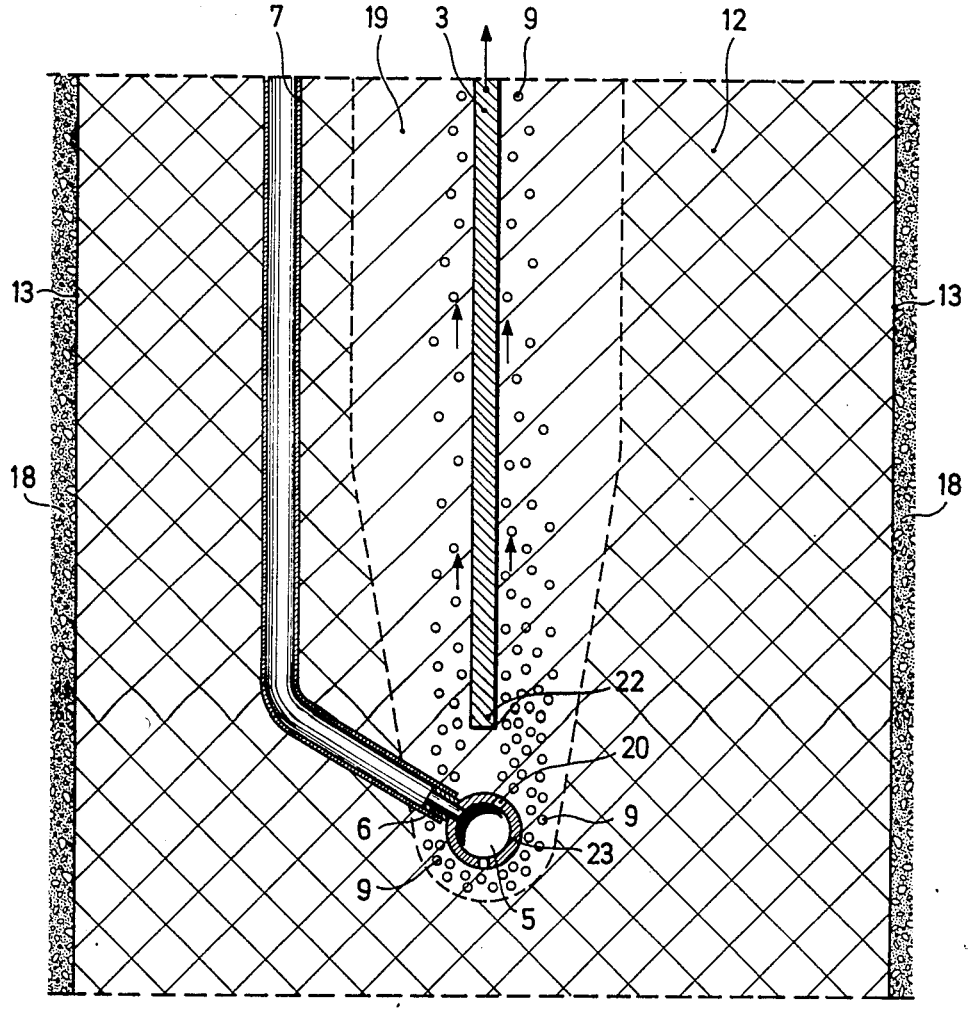
FIG. 1 is a schematic cross-sectional view through one inventive arrangement showing the slotted wall, a diaphragm, and an air distributing device.
Figure 5:
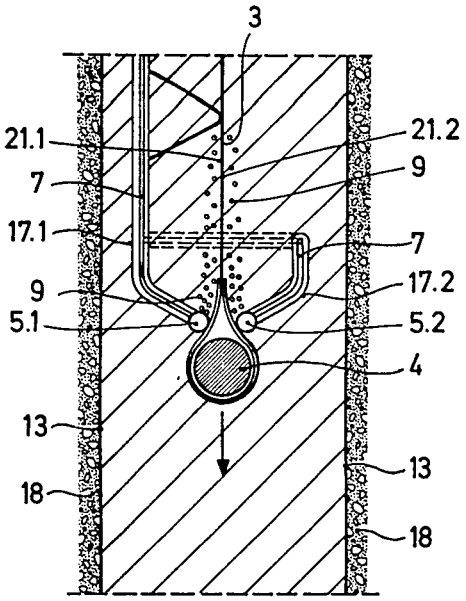
FIG. 5 is a schematic cross-sectional illustration through the slotted wall and a frame for introducing the diaphragm.

Referring now to the drawings in detail, FIG. 1 illustrates the lower end 22 of a diaphragm section 3 during introduction of the latter into the slotted wall suspension 12. Disposed below the diaphragm end 22 is an air distributing device 5, which can, for example, be comprised of a perforated pipe 23. The air distributing device 5 is connected with the supply line 7 via a connecting member 6. Compressed air is forced into the air distributing device 5 via this supply line 7. The compressed air leaves the air distributing device 5, in the form of air bubbles 9, via the openings 20; these air bubbles 9 ascend along the diaphragm surfaces 21.1 and 21.2 (FIGS. 3 and 5). Due to its upward movement, this stream of air bubbles loosens the structure of the clay/-mineral platelets, so that the viscosity is considerably reduced in a boundary layer 19 between the diaphragm surfaces 21.1, 21.2 and the unmoved support suspension 12 of bentonite and water, and the density is reduced in conformity with the quantity of air in the bubbles 9. The considerable reduction of the shearing stress $\tau_0$ connected therewith, and the buoyant force A at the diaphragm 3, make it considerably easier to position the diaphragm in the slotted wall.

The upward flow of the slotted wall suspension in the boundary layer 19 is determined by the ascending air bubbles and the varying densities of the boundary layer 19 and the support suspension 12, and is compensated for by the slow settling of the support suspension 12.

To prevent the boundary layer 19 from becoming too large where the wall is fairly deep, the diaphragm 3 can be introduced slowly into the support suspension 12, and/or the quantity and pressure of the air can be regulated, and/or the air bubbles 9 can be injected or can bubble up on one side. A further possibility is limiting the width of the diaphragm section 3, since experience has shown that a brief and locally limited disturbance of the support suspension 12, such as by the slotted wall gripper, has no negative effect on the support action of the support suspension 12 between the boundary surfaces 13 of the slotted wall relative to the existing ground 18.

FIG. 2, which is a longitudinal section through the slotted wall, schematically illustrates one exemplary apparatus for introducing a diaphragm section 3.2.

The diaphragm section 3.2 is introduced into the slotted wall along a joint or contact 10.1 of the already introduced diaphragm section 3.1, and a joint or contact 10.2. A weight 4 and an air distributing device 5 are mounted on the lower end 22 of the diaphragm section 3.2. The air distributing device 5 communicates via a connecting member 6 and a supply line 7 with a compressed air generator and/or tank 8 outside the slot. Air bubbles 9 are produced via openings in the air distributing device 5, with these air bubbles ascending along the surfaces of the diaphragm. Depending upon the connection mechanism 10 selected for interconnecting the diaphragm sections 3.1 and 3.2, and the method of producing the slotted wall, an additional pare tube 11 can advantageously be positioned on the vertical, narrow-sided delimitation of the slotted wall against the ground 18. In this connection, the contact or joint 10.3 can be suitably guided in a pare tube 11 in a manner which need not be specifically described.

FIG. 3 shows a cross-sectional view through an exemplary arrangement of the air distributing device 5 at the lower end of the diaphragm section. As desired, the air distributing device 5 can comprise the illustrated perforated or slotted pipe 5, or can comprise a flexible hose having perforations, holes, slots, or a porous wall for the passage of the air bubbles 9, with the dimensions of the openings at the same time determining the size of the air bubbles.

In the exemplary embodiment of FIG. 3, the air distributing device 5 is mounted below the lower edge 22 of the diaphragm section 3 on the suspension or mounting brackets 14 for the weight 4. The air bubbles 9 ascend along the diaphragm surfaces 21.1 and 21.2, and produce the previously described positive effects by the locally limited movement of the support suspension 12. Not illustrated is the possibility of providing air bubbles 9 on only one side of the membrane surfaces. This advantageous variation of the present invention is utilized when the intermediate space between one of the diaphragm surfaces 21.1 or 21.2 and the boundary line 13 of the slotted wall to the ground 18 is not to be disturbed.

Figure 4:
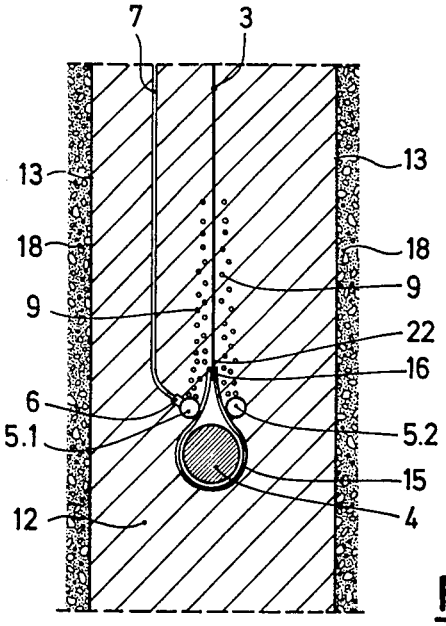
FIG. 4 is a schematic cross-sectional view through the bottom end of the diaphragm.

FIG. 4 shows a further exemplary arrangement of the air distributing device 5. With this embodiment, the weight 4 is glued or welded into a loop 15 on the lower diaphragm end 22. At least one air distributing pipe 5.1 or 5.2 is mounted on the diaphragm 3 in the region of the weld or glue area 16. After the diaphragm section has been lowered, the supply hose 7 can be released from the connection 6, so that the air distributing mechanism 5 can remain in the slot.

FIG. 5 illustrates an exemplary apparatus for positioning the diaphragm in the support suspension 12 by means of a frame 17. In order to be able to force the diaphragm section 3 downwardly, the looped-in weight 4 is fastened between the lower frame parts 17.1 and 17.2. The air distributing device 5 is integrated into the lower crossframe of the frame parts 17.1 and 17.2. The air distributing device 5 is connected via supply lines 7 with the compressed air generator 8. This exemplary apparatus has the additional advantage that retraction of the frame after the diaphragm section 3 has been lowered is facilitated by the further production of air bubbles 9 during the retraction process, and an unintentional pulling along of the diaphragm section 3 is prevented.

The present invention is, of course, in no way restricted to the specific disclosure of the specification and drawings, but also encompasses any modifications within the scope of the appended claims.

What we claim is:

1. An apparatus for positioning diaphragms in vertical slotted walls which are supported by a support suspension having a thixotropic structure, with respective diaphragm sections being lowered substantially centrally into the support suspension of the sealing wall mass; said apparatus comprises:

at least one air distributing device disposed at the bottom edge of said diaphragm section during the positioning process;

a supply line which connects said air distributing device to a source of compressed air to produce an upwardly directed flow of air bubbles for locally limited dissolution of the thixotropic structure of said support suspension and for reduction of specific weight of said support suspension having air bubble flow therethrough as well as for reduction of buoyancy lift force; and a ballast weight connected to the bottom edge of said diaphragm section, with said air distributing device being connected to said ballast weight.

2. An apparatus according to claim 1, in which said air distributing device comprises a perforated pipe.

3. An apparatus according to claim 1, in which said air distributing device comprises a slotted pipe.

4. An apparatus according to claim 1, in which said air distributing device comprises a flexible perforated hose.

5. An apparatus according to claim 1, in which said air distributing device comprises a flexible slotted hose.

6. An apparatus according to claim 1, in which said air distributing device comprises a flexible porous hose.

7. An apparatus according to claim 1, in which said air distributing device is connected to said diaphragm section.

8. An apparatus according to claim 1, which includes a rigid frame for said positioning of said diaphragm section, with said air distributing device being connected to said frame.

9. An apparatus according to claim 1, in which said supply line is detachably connected to said air distributing device.

10. An apparatus according to claim 1, wherein at least part of said air distributing device is left in said slotted wall along with said diaphragm section.

11. An apparatus according to claim 1, wherein said air distributing device, after completing positioning of said membrane section, is subject to at least partially retracting and reusing of said device.

12. An apparatus for positioning diaphragms in vertical slotted walls which are supported by a support suspension having a thixotropic structure, with respective diaphragm sections being lowered substantially centrally into the support suspension of the sealing wall mass; said apparatus comprises:

at least one air distributing device disposed at the bottom edge of said diaphragm section during the positioning process;

a supply line which connects said air distributing device to a source of compressed air to produce an upwardly directed flow of air bubbles for locally limited dissolution of the thixotropic structure of said support suspension and for reduction of specific weight of said support suspension having air bubble flow therethrough as well as for reduction of buoyancy lift force;

a ballast weight; and a mounting bracket which is connected to the bottom edge of said diaphragm section and supports said ballast weight, with said air distributing device being connected to said mounting bracket.

13. An apparatus according to claim 12, in which said air distributing device comprises a perforated pipe.

14. An apparatus according to claim 12, in which said air distributing device comprises a slotted pipe.

15. An apparatus according to claim 12, in which said air distributing device comprises a flexible perforated hose.

16. An apparatus according to claim 12, in which said air distributing device comprises a flexible slotted hose.

17. An apparatus according to claim 12, in which said air distributing device comprises a flexible porous hose.

18. An apparatus according to claim 12, in which said air distributing device is connected to said diaphragm section.

19. An apparatus according to claim 12, which includes a rigid frame for said positioning of said diaphragm section, with said air distributing device being connected to said frame.

20. An apparatus according to claim 12, in which said supply line is detachably connected to said air distributing device.

21. An apparatus according to claim 12, wherein at least part of said air distributing device is left in said slotted wall along with said diaphragm section.

22. An apparatus according to claim 12, wherein said air distributing device, after completing positioning of said membrane section, is subject to at least partially retracting and reusing said device.

* * * * *